US008821967B2

(12) United States Patent
Wu et al.

(10) Patent No.: US 8,821,967 B2
(45) Date of Patent: Sep. 2, 2014

(54) METHOD FOR MANUFACTURING AN OXIDE THIN FILM

(75) Inventors: Jih-Jen Wu, Tainan (TW); Wei-Ting Wu, Tainan (TW); Ching-Mei Wang, Tainan (TW); Jen-Sue Chen, Tainan (TW)

(73) Assignee: National Cheng Kung University, Tainan (TW)

( * ) Notice: Subject to any disclaimer, the term of this patent is extended or adjusted under 35 U.S.C. 154(b) by 305 days.

(21) Appl. No.: 13/083,299

(22) Filed: Apr. 8, 2011

(65) Prior Publication Data

US 2012/0082782 A1 Apr. 5, 2012

(30) Foreign Application Priority Data

| | | |
|---|---|---|
| Oct. 4, 2010 | (TW) | 99133704 A |
| Oct. 4, 2010 | (TW) | 99133705 A |
| Oct. 4, 2010 | (TW) | 99133706 A |
| Oct. 4, 2010 | (TW) | 99133707 A |
| Oct. 4, 2010 | (TW) | 99133708 A |

(51) Int. Cl.

| | |
|---|---|
| ***B05D 5/12*** | (2006.01) |
| ***B05D 3/02*** | (2006.01) |
| ***C23C 24/08*** | (2006.01) |
| ***C23C 18/12*** | (2006.01) |

(52) U.S. Cl.

CPC ..... *C23C 24/082* (2013.01); *C23C 18/127* (2013.01); *C23C 18/1245* (2013.01); *C23C 18/1216* (2013.01)

USPC ..... 427/108; 427/372.2; 427/383.1

(58) Field of Classification Search

None

See application file for complete search history.

(56) References Cited

U.S. PATENT DOCUMENTS

| | | | | |
|---|---|---|---|---|
| 2002/0132142 | A1 | 9/2002 | Windisch, Jr. et al. | |
| 2003/0099849 | A1 * | 5/2003 | Wu et al. | 428/472 |
| 2008/0119352 | A1 * | 5/2008 | Kitaguchi | 502/74 |
| 2009/0311169 | A1 * | 12/2009 | Rajeshwar et al. | 423/606 |
| 2010/0028718 | A1 | 2/2010 | Oboodi et al. | |
| 2010/0233356 | A1 * | 9/2010 | Jang et al. | 427/58 |

FOREIGN PATENT DOCUMENTS

| | | | | |
|---|---|---|---|---|
| CN | 101125676 A | | 2/2008 | |
| CN | 101407399 A | | 4/2009 | |
| CN | 101734866 A | | 6/2010 | |
| TW | 201215652 A | | 4/2012 | |
| WO | WO 00/32571 | * | 8/2000 | C07C 407/00 |

OTHER PUBLICATIONS

Lima et al., "Electroluminescence of zinc oxide thin-films prepared via polymeric precursor and via sol—gel methods", Thin Solid Films 516 (2007) pp. 165-169.*

Material Safety Data Sheet Tungstic Acid, Nov. 20, 2008.*

Su et al., "Hydrothermal synthesis of uniform WO3 submicrospheres using thiourea as an assistant agent", Materials Characterization, 61 (2010), pp. 831-832.*

(Continued)

*Primary Examiner* — Timothy Meeks

*Assistant Examiner* — Ina Agaj

(74) *Attorney, Agent, or Firm* — Tim Tingkang Xia, Esq.; Morris, Manning & Martin, LLP

(57) ABSTRACT

A method for manufacturing an oxide thin film comprises: providing a coating material composed of a first precursor material, a fuel material and a solvent; coating the coating material on a substrate; and annealing the coated coating material on the substrate to convert the coated coating material into an oxide thin film.

11 Claims, 8 Drawing Sheets

(56) References Cited

OTHER PUBLICATIONS

Intellectual Property Office, Ministry of Economic Affairs, R.O.C., "Office Action", Mar. 7, 2013, Taiwan.
Wei-Ting Wu et al., An Efficient Route to Nanostructured Tungsten Oxide Films with Improved Electrochromic Properties, ChemPhysChem, 2010, P3306-3312, vol. 11.
Intellectual Property Office, Ministry of Economic Affairs, R.O.C., "Office Action", Jul. 3, 2013, Taiwan.
Intellectual Property Office, Ministry of Economic Affairs, R.O.C., "Office Action", May 3, 2013, Taiwan.
Sun, Qing Jun et al., Hydrothermal and Microwave Hydrothermal Synthesis of Tungsten Oxide Nanopowders with Controllable Morphology, 2009, vol. 2, Xinjiang University.

* cited by examiner

METHOD FOR MANUFACTURING AN OXIDE THIN FILM

CROSS-REFERENCE TO RELATED APPLICATIONS

This non-provisional application claims priority under 35 U.S.C. §119(a) on Patent Application Nos. 099133704, 099133705, 099133706, 099133707 and 099133708, filed in Taiwan, R.O.C. on Oct. 4, 2010, the entire contents of which are hereby incorporated by reference.

FIELD OF THE INVENTION

The invention relates to a method for manufacturing a thin film, more particularly, to a method for manufacturing an oxide thin film.

BACKGROUND OF THE INVENTION

Oxide thin films have been widely used in semiconductor industries and optoelectronic industries. Generally, oxide thin films are manufactured through gas-phase method and liquid-phase method.

Gas-phase method, i.e. evaporation method and sputtering method, is implemented in a vacuum chamber with an expensive device. Prior to manufacturing the oxide thin film, vacuuming the chamber is crucial and necessary. However, vacuuming the vacuum chamber is time-consuming and the vacuum chamber limits area for the oxide thin film to grow.

Liquid-phase method, i.e. sol-gel method and aqueous solution method, is complicated, time-consuming and disadvantageous to control morphology and characteristic of the oxide thin film while being implemented. For instance, a tungsten oxide thin film through aqueous solution method is prepared by following steps. Tungsten powder and hydrogen peroxide are blended for 6 hours. After removing the excessive hydrogen peroxide, a first solution is obtained. Acetate and the first solution are blended and refluxed for 12 hours and a second solution is obtained. Then a vacuuming process is implemented to the second solution, a surfactant is blended with the second solution for 1 hour and a third solution is obtained. The third solution is then placed on a spinning device to use a centrifugal force to separate the third solution, and a settled solution is obtained. Finally, the settled solution is coated on a substrate and heated to form a tungsten oxide thin film on the substrate. However, the oxide thin film is un-reproducible because process parameters are not easy to be controlled in liquid-phase method. That is, if the process parameters, i.e. blending time and depositing time of the foregoing solutions, are slightly varied, an oxide thin film of different morphology and characteristic is manufactured.

SUMMARY OF THE INVENTION

An objective of the invention is to provide a method for manufacturing an oxide thin film, which is not implemented in a vacuum chamber with an expensive device so that an oxide thin film with low cost on large area can be manufactured.

A further objective of the invention is to provide a method for manufacturing an oxide thin film, which is uncomplicated and time-saving, and is used to manufacture an oxide thin film with reproducibility.

A further objective of the invention is to provide a method for manufacturing an oxide thin film, which is used to modify morphology and characteristic of an oxide thin film by varying process parameters therein.

A further objective of the invention is to provide a method for manufacturing an oxide thin film, which is applicable to electrochromic device, solar cell and semiconductor.

The method for manufacturing an oxide thin film in accordance with the invention comprises:

providing a coating material composed of a first precursor material, a fuel material and a solvent;

coating the coating material on a substrate; and annealing the coated coating material on the substrate to convert the coated coating material into an oxide thin film.

DETAILED DESCRIPTION OF THE INVENTION

Figure 1A:
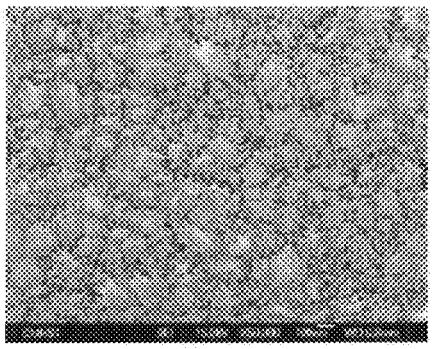
FIG. 1A is a scanning electron microscope (SEM) image of a tungsten oxide thin film of Example 1.

A method for manufacturing an oxide thin film comprises:

providing a coating material composed of a first precursor material, a fuel material and a solvent;

coating the coating material on a substrate; and annealing the coated coating material on the substrate to convert the coated coating material into an oxide thin film.

In some embodiments of the invention, the oxide thin film is a metal oxide thin film. Preferably, the metal oxide thin film is a tungsten oxide thin film, a nickel oxide thin film, a titanium oxide thin film, a zinc oxide thin film, a copper oxide thin film or a silver oxide thin film.

In some embodiments of the invention, the first precursor material is a first metal-containing material and the first metal is tungsten, nickel, titanium, zinc, copper or silver. Preferably, the first precursor material is selected from a group consisting of powder of the first metal, nitrate of the first metal, sulphate of the first metal, acetate of the first metal and combination thereof. In one embodiment of the invention, when the oxide thin film is a tungsten oxide thin film, the first precursor material is selected from a group consisting of tungsten powder, tungsten nitrate, tungsten sulphate, tungsten acetate and combination thereof. In another embodiment of the invention, when the oxide thin film is a nickel oxide thin film, the first precursor material is selected from a group consisting of nickel powder, nickel nitrate, nickel sulphate, nickel acetate and combination thereof.

In some embodiments of the invention, the fuel material is selected from a group consisting of thiourea, urea, glycine, citric acid and combination thereof.

In some embodiments of the invention, the solvent is selected from a group consisting of water, ethanol, hydrogen peroxide and combination thereof.

In some embodiments of the invention, the substrate is a glass or a transparent conducting oxide. Preferably, the transparent conducting oxide is an indium tin oxide (ITO) or a fluorine tin oxide (FTO).

It's worth mentioning that the first precursor material and the fuel material are in a relative weight ratio relationship, ranging from 1:0.02 to 1:22. In some embodiments of the invention, when the oxide thin film is a tungsten oxide thin film, the first precursor material and the fuel material are in a relative weight ratio relationship, ranging from 1:0.1 to 1:1.64. In some embodiments of the invention, when the oxide thin film is a nickel oxide thin film, the first precursor material and the fuel material are in a relative weight ratio relationship, ranging from 1:0.3 to 1:2.24.

It's worth mentioning that the fuel material and the solvent are in a relative weight ratio relationship, ranging from 1:0.01 to 1:100. In some embodiments of the invention, when the oxide thin film is a tungsten oxide thin film, the fuel material and the solvent are in a relative weight ratio relationship, ranging from 1:9 to 1:60. In some embodiments of the invention, when the oxide thin film is a nickel oxide thin film, the fuel material and the solvent are in a relative weight ratio relationship, ranging from 1:0.03 to 1:40.

Furthermore, the coating material comprises a second precursor material for doping the oxide thin film. The second precursor material is a second metal-containing material, and the second metal is tungsten, nickel, titanium, zinc, copper or silver yet different in nature from the first metal. Preferably, the second precursor material is selected from a group consisting of powder of the second metal, nitrate of the second metal, sulphate of the second metal, acetate of the second metal and combination thereof. In some embodiments of the invention, the first precursor material and the second precursor material are in a relative weight ratio relationship, ranging from 1:0.001 to 1:0.1.

It's important that the coated coating material on the substrate is annealed at a relative low temperature because heat or gas is produced when the coating material is provided and the coated coating material on the substrate is annealed. Preferably, the coated coating material on the substrate is annealed at 300 to 550° C. More preferably, the coated coating material on the substrate is annealed at 300 to 550° C. for 10 minutes to 6 hours. Most preferably, the coated coating material on the substrate is annealed at 300 to 550° C. for 10 minutes to 1 hour.

In one embodiment of the invention, when the oxide thin film is a tungsten oxide thin film, the coated coating material on the substrate is annealed at 350 to 450° C. In another embodiment, the oxide thin film is a nickel oxide thin film, the coated coating material on the substrate is annealed at 300 to 550° C.

It's notable that when the oxide thin film is a cracked tungsten oxide thin film, a method for manufacturing the cracked tungsten oxide thin film comprises: providing a tungsten-containing coating material composed of tungsten powder, thiourea and hydrogen peroxide, wherein the tungsten powder and the thiourea are in a relative weight ratio relationship, ranging from 1:0.4 to 1:2, and the thiourea and the hydrogen peroxide are in a relative weight ratio relationship, ranging from 1:15 to 1:25; coating the tungsten-containing coating material on a substrate; and annealing the coated tungsten-containing coating material on the substrate at 425 to 550° C. for 10 minutes to 1 hour to convert the coated tungsten-containing coating material into the cracked tungsten oxide thin film.

It's notable that when the oxide thin film is a porous tungsten oxide thin film, a method for manufacturing the porous tungsten oxide thin film comprises: providing a tungsten-containing coating material composed of tungsten powder, thiourea and hydrogen peroxide, wherein the tungsten powder and the thiourea are in a relative weight ratio relationship, ranging from 1:0.2 to 1:0.4, and the thiourea and the hydrogen peroxide are in a relative weight ratio relationship, ranging from 1:15 to 1:25; coating the tungsten-containing coating material on a substrate; and annealing the coated tungsten-containing coating material on the substrate at 425 to 550° C. for 10 minutes to 1 hour to convert the coated tungsten-containing coating material into the porous tungsten oxide thin film.

It's notable that when the oxide thin film is a flat or amorphous tungsten oxide thin film, a method for manufacturing the flat or amorphous tungsten oxide thin film comprises: providing a tungsten-containing coating material composed of tungsten powder, thiourea and hydrogen peroxide, wherein the tungsten powder and the thiourea are in a relative weight ratio relationship, ranging from 1:0.2 to 1:0.4, and the thiourea and the hydrogen peroxide are in a relative weight ratio relationship, ranging from 1:15 to 1:25; coating the tungsten-containing coating material on a substrate; and annealing the coated tungsten-containing coating material on the substrate at 300 to 425° C. for 10 minutes to 1 hour to convert the coated tungsten-containing coating material into the flat or amorphous tungsten oxide thin film.

It's notable that when the oxide thin film is a flat tungsten oxide thin film, a method for manufacturing the flat tungsten oxide thin film comprises: providing a tungsten-containing coating material composed of tungsten powder, urea and hydrogen peroxide, wherein the tungsten powder and the urea are in a relative weight ratio relationship, ranging from 1:0.2 to 1:0.4, and the urea and the hydrogen peroxide are in a relative weight ratio relationship, ranging from 1:15 to 1:25; coating the tungsten-containing coating material on a substrate; and annealing the coated tungsten-containing coating material on the substrate at 425 to 550° C. for 10 minutes to 1 hour to convert the coated tungsten-containing coating material into the flat tungsten oxide thin film.

It's notable that when the oxide thin film is a porous tungsten oxide thin film, a method for manufacturing the porous tungsten oxide thin film comprises: providing a tungsten-containing coating material composed of tungsten powder, glycine and hydrogen peroxide, wherein the tungsten powder and the glycine are in a relative weight ratio relationship, ranging from 1:0.2 to 1:0.4, and the glycine and the hydrogen peroxide are in a relative weight ratio relationship, ranging from 1:15 to 1:25; coating the tungsten-containing coating material on a substrate; and annealing the coated tungsten-containing coating material on the substrate at 425 to 550° C. for 10 minutes to 1 hour to convert the coated tungsten-containing coating material into the porous tungsten oxide thin film.

It's notable that when the oxide thin film is a porous tungsten oxide thin film, a method for manufacturing the porous tungsten oxide thin film comprises: providing a tungsten-containing coating material composed of tungsten powder, citric acid and hydrogen peroxide, wherein the tungsten powder and the citric acid are in a relative weight ratio relationship, ranging from 1:0.2 to 1:0.4, and the citric acid and the hydrogen peroxide are in a relative weight ratio relationship, ranging from 1:15 to 1:25; coating the tungsten-containing coating material on a substrate; and annealing the coated tungsten-containing coating material on the substrate at 425 to 550° C. for 10 minutes to 1 hour to convert the tungsten-containing coating material into the porous tungsten oxide thin film.

Following examples are for further illustration of the invention but not intended to limit the invention. Any modifications and applications by persons skilled in art of the invention should be within scope of the invention.

Synthesis of Tungsten Oxide Thin Films

Example 1

A tungsten oxide thin film of Example 1 is prepared by following steps.

1.5 g tungsten powder, 0.45 g thiourea, 9 ml hydrogen peroxide (concentration: 30%) and 1 ml deionized distilled water are blended and a solution is obtained. The solution is stirred constantly for evaporating until the solution is weighed 4.5 g. Thus, a tungsten-containing coating material is then obtained.

The tungsten-containing coating material is spinningly coated on an FTO and then annealing treatment is employed to turn the tungsten containing coating material into the tungsten oxide thin film. The annealing treatment is implemented as follows: the tungsten-containing coating material on the FTO is heated from room temperature to 350° C. for 10 minutes and from 350° C. to 450° C. for 5 minutes, and the temperature is maintained for 30 minutes thereafter.

With reference to FIG. 1A, the tungsten oxide thin film of Example 1 is a porous tungsten oxide thin film.

Example 2

A tungsten oxide thin film of Example 2 is prepared by steps similar to the tungsten oxide thin film in Example 1, except that urea is substituted for the thiourea.

Figure 1B:
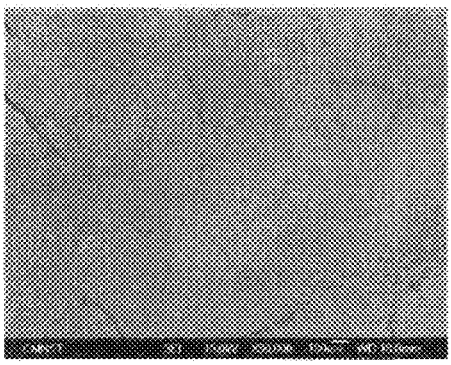
FIG. 1B is an SEM image of a tungsten oxide thin film of Example 2.

With reference to FIG. 1B, the tungsten oxide thin film of Example 2 is a flat tungsten oxide thin film.

Example 3

A tungsten oxide thin film of Example 3 is prepared by steps similar to the tungsten oxide thin film in Example 1, except that glycine is substituted for the thiourea.

Figure 1C:
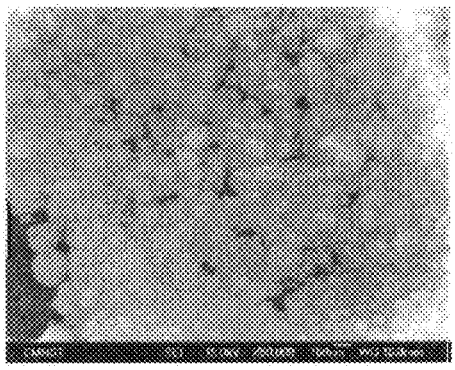
FIG. 1C is an SEM image of a tungsten oxide thin film of Example 3.

With reference to FIG. 1C, the tungsten oxide thin film of Example 3 is a porous tungsten oxide thin film.

Example 4

A tungsten oxide thin film of Example 4 is prepared by steps similar to the tungsten oxide thin film in Example 1, except that citric acid is substituted for the thiourea.

Figure 1D:
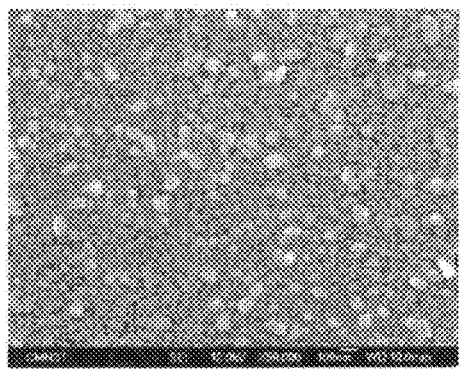
FIG. 1D is an SEM image of a tungsten oxide thin film of Example 4.

With reference to FIG. 1D, the tungsten oxide thin film of Example 4 is a porous tungsten oxide thin film.

Example 5

A tungsten oxide thin film of Example 5 is prepared by steps similar to the tungsten oxide thin film in Example 1, except that the weight of the thiourea is 1.215 g.

Figure 1E:
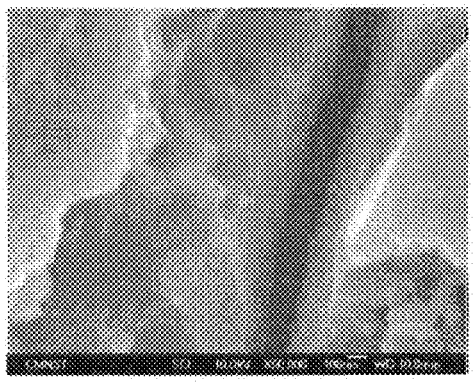
FIG. 1E is an SEM image of a tungsten oxide thin film of Example 5.

With reference to FIG. 1E, the tungsten oxide thin film of Example 5 is a cracked tungsten oxide thin film.

Example 6

A tungsten oxide thin film of Example 6 is prepared by steps similar to the tungsten oxide thin film in Example 1, except that the weight of the thiourea is 0.6 g.

Figure 1F:
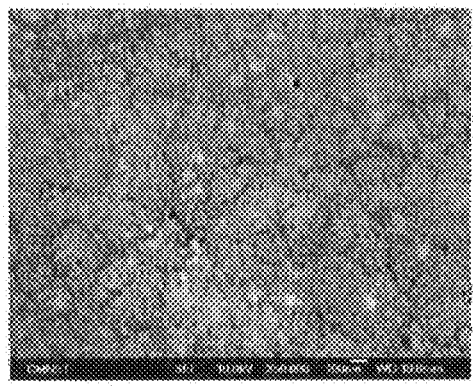
FIG. 1F is an SEM image of a tungsten oxide thin film of Example 6.

With reference to FIG. 1F, the tungsten oxide thin film of Example 6 is a porous tungsten oxide thin film.

Example 7

A tungsten oxide thin film of Example 7 is prepared by steps similar to the tungsten oxide thin film in Example 1, except that the annealing treatment is implemented as follows: the coated tungsten-containing coating material on the FTO is heated from room temperature to 350° C. for 10 minutes and from 350° C. to 400° C. for 5 minutes, and the temperature is maintained for 30 minutes thereafter.

Figure 1G:
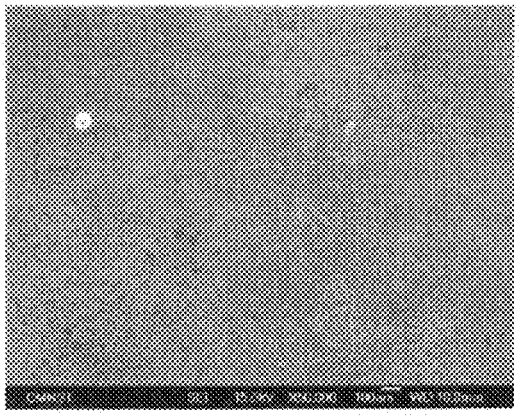
FIG. 1G is an SEM image of a tungsten oxide thin film of Example 7.

With reference to FIG. 1G, the tungsten oxide thin film of Example 7 is a flat tungsten oxide thin film.

Example 8

A tungsten oxide thin film of Example 8 is prepared by steps similar to the tungsten oxide thin film of Example 1, except that the annealing treatment is implemented as follows: the coated tungsten-containing coating material on the FTO is heated from room temperature to 350° C. for 10 minutes and from 350° C. to 500° C. for 5 minutes, and the temperature is maintained for 30 minutes thereafter.

Figure 1H:
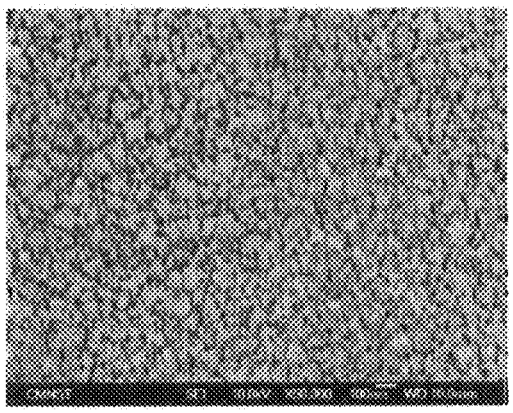
FIG. 1H is an SEM image of a tungsten oxide thin film of Example 8.

With reference to FIG. 1H, the tungsten oxide thin film of Example 8 is a porous tungsten oxide thin film.

Comparative Example

A tungsten oxide thin film of Comparative Example is prepared by steps similar to the tungsten oxide thin film in Example 1, except that the thiourea is not blended.

Figure 1I:
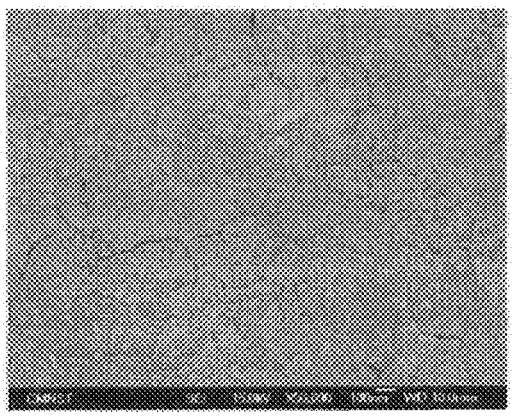
FIG. 1I is an SEM image of a tungsten oxide thin film of Comparative Example.

With reference to FIG. 1I, the tungsten oxide thin film of Comparative Example is a flat tungsten oxide thin film.

Structural Analysis

Figure 2:
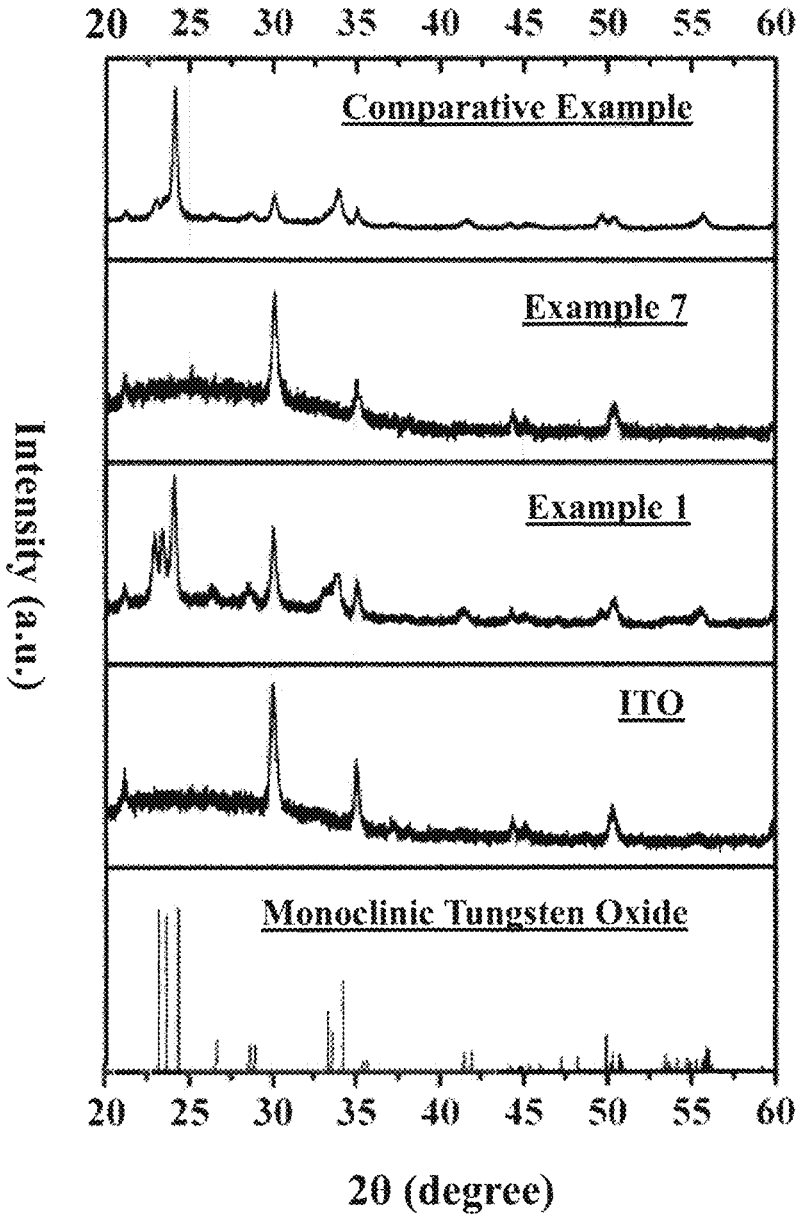
FIG. 2 is a graph to illustrate X-ray diffraction (XRD) spectra of the tungsten oxide thin films of Examples 1, 7 and Comparative Example.

With reference to FIG. 2, X-ray diffraction (XRD) spectra showing the tungsten oxide thin films of Examples 1, 7 and Comparative Example are presented, wherein it is noted that the tungsten oxide thin films of Example 1 and Comparative Example are polycrystalline and have monoclinic-phase structure, and however, the tungsten oxide thin film of Example 7 has only peaks similar to ITO.

Figure 3:
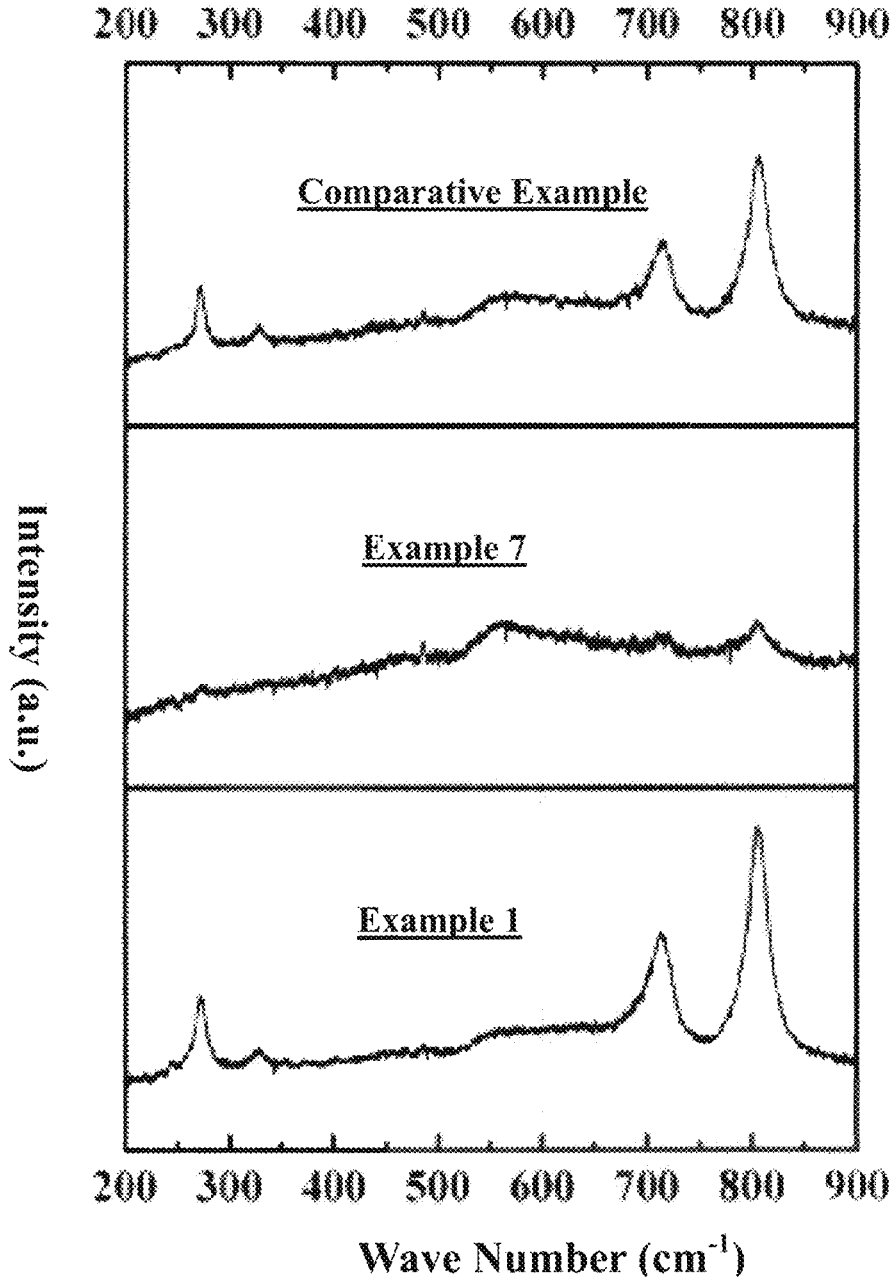
FIG. 3 is a graph to illustrate Raman spectra of the tungsten oxide thin films of Examples 1, 7 and Comparative Example.

With reference to FIG. 3, Raman spectra of the tungsten oxide thin films of Examples 1, 7 and Comparative Example are presented, wherein it is noted that the tungsten oxide thin films of Example 1 and Comparative Example have scattering peaks at 805 $cm^{-1}$, 714 $cm^{-1}$, 327 $cm^{-1}$ and 272 $cm^{-1}$, which further demonstrates that the tungsten oxide thin films of Example 1 and Comparative Example possess monoclinic-phase structure, and however, the tungsten oxide thin film of Example 7 has scattering peaks at 805 $cm^{-1}$ and 714 $cm^{-1}$ but the scattering peaks of Example 7 is weaker and wider than those of Example 1 and Comparative Example.

Optoelectronic Property

Optoelectronic properties of the tungsten oxide thin films are analyzed by tri-electrode system and electrochromic device.

In the tri-electrode system, 1M lithium perchlorate is used as an electrolyte, in which prpopylene carbonate is used as a solvent. Moreover, in the tri-electrode system, the tungsten oxide thin film, Pt wire and Ag/AgCl are used as a working electrode, an auxiliary electrode and a reference electrode, respectively.

In the electrochromic device, a hot-melt surlyn spacer is placed between an ITO counter electrode and the tungsten oxide thin film so as to form a space and an electrolyte (1M lithium perchlorate, in which prpopylene carbonate is used as a solvent) is directed to the space via capillarity.

In either the tri-electrode system or the electrochromic device, when a reverse bias is applied to the tungsten oxide thin film, lithium ions are captured by the tungsten oxide thin film so that the tungsten oxide thin film colors. In addition, when a forward bias is applied to the tungsten oxide thin film, the lithium ions are released from the tungsten oxide thin film so that the tungsten oxide thin film bleaches.

Figure 4:
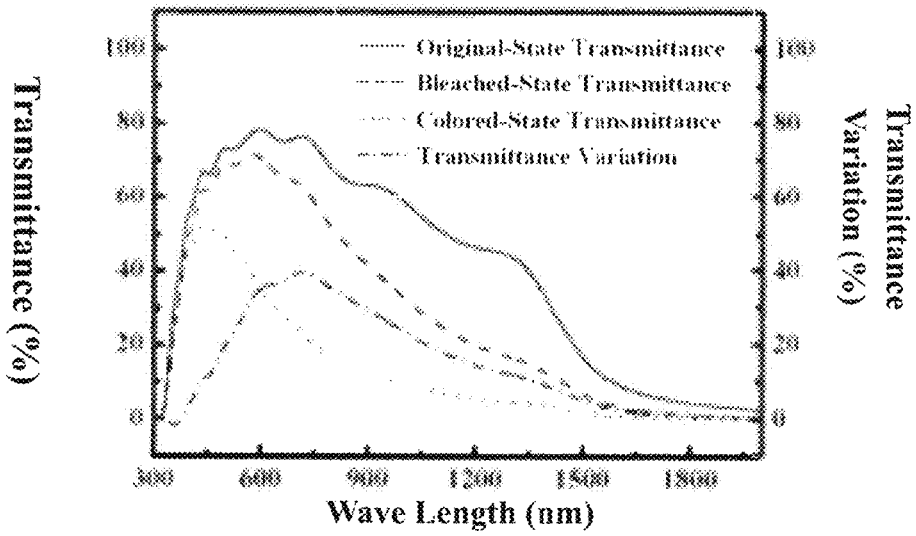
FIG. 4 is a graph to illustrate a transmittance curve and a transmittance variation curve of the tungsten oxide thin film, in tri-electrode system, of Example 1.
Figure 5:
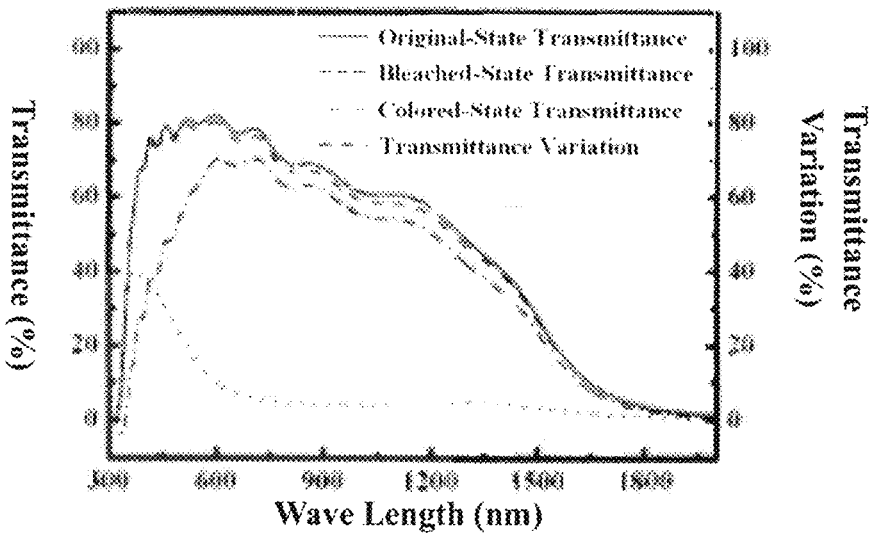
FIG. 5 is a graph to illustrate a transmittance curve and a transmittance variation curve of the tungsten oxide thin film, in tri-electrode system, of Example 7.
Figure 6:
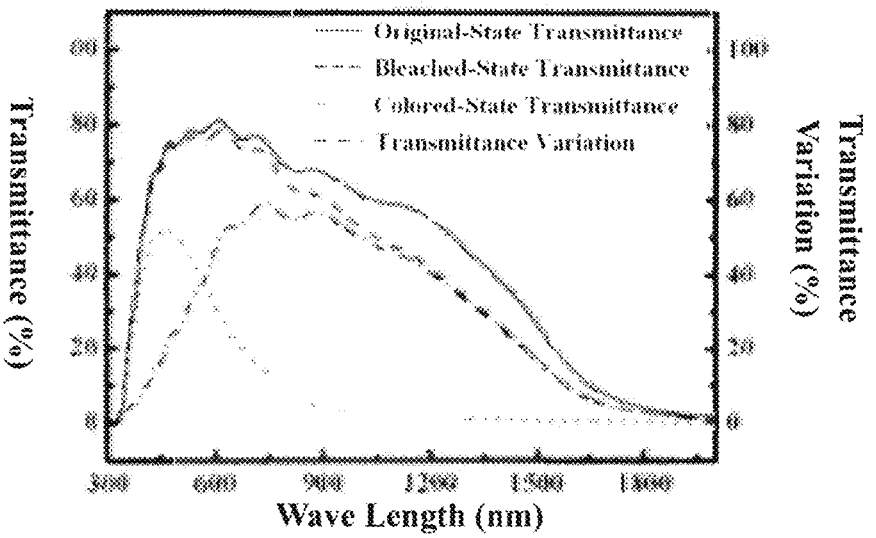
FIG. 6 is a graph to illustrate a transmittance curve and a transmittance variation curve of the tungsten oxide thin film, in tri-electrode system, of Comparative Example.

With reference to FIGS. 4 to 6, transmittance curves and transmittance variation curves of the tungsten oxide thin films, in the tri-electrode system, of Examples 1, 7 and Comparative Example are respectively shown, wherein "Original-State Transmittance" is defined as a transmittance curve of the tungsten oxide thin film in a state in which neither reverse bias nor forward bias is applied to the tungsten oxide thin film; "Colored-State Transmittance" is defined as transmittance curve of the tungsten oxide thin film in a state in which a reverse bias is applied to the tungsten oxide thin film; "Bleached-State Transmittance" is defined as transmittance curve of the tungsten oxide thin film in a state in which a forward bias is applied to the tungsten oxide thin film; "Transmittance Variation" is defined as transmittance curve of "Bleached-State Transmittance" minus "Colored-State Transmittance." Thus, the tungsten oxide thin films of Examples 1, 7 and Comparative Example have approximately 80% transmittance in the original-state, and the tungsten oxide thin films of Examples 1, 7 and Comparative Example have approximately 20%, 10% and 25% transmittance to light of 632 nm in the colored-state, respectively.

With further reference to FIGS. 4 to 6, the tungsten oxide thin film of Example 7 has a transmittance curve in the bleached-state similar to the transmittance curve in the original-state. However, the transmittance curve of the tungsten oxide thin film of Example 1 in the bleached-state is lower than that in the original-state. Further, the transmittance curve of the tungsten oxide thin film of Comparative Example in the bleached-state is even lower than that in the original-state. Hence, it is noted that the tungsten oxide thin film in Example 7 has the largest transmittance variation to light of 632 nm.

Figure 7:
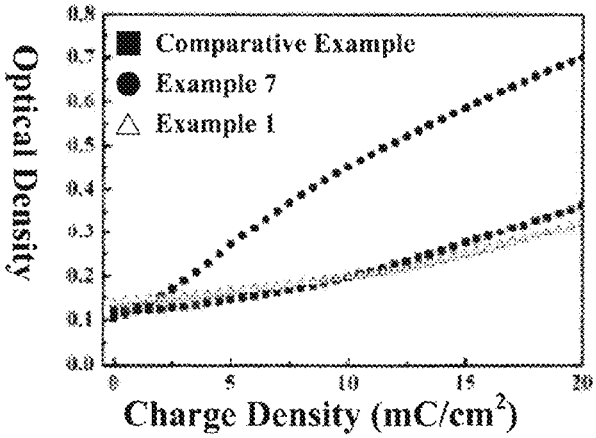
FIG. 7 is a graph to illustrate a curve relationship between a charge density and an optical density when the tungsten oxide thin films, in electrochromic device, of Examples 1, 7 and Comparative Example are provided with 10 $\mu A/cm^2$ current density and reacted with a solvent.

With reference to FIG. 7, a graph shows a curve relationship between a charge density and an optical density when the tungsten oxide thin films, in the electrochromic device, of Examples 1, 7 and Comparative Example are provided with 10 $\mu A/cm^2$ current density and reacted with the solvent. From slopes of the curves, it is learned that coloring efficiencies of the tungsten oxide thin films of Examples 1, 7 and Comparative Example are 6 $cm^2/C$, 37 $cm^2/C$ and 7 $cm^2/C$, respectively. Obviously, the tungsten oxide thin film of Example 7 has the highest coloring efficiency.

Figure 8:
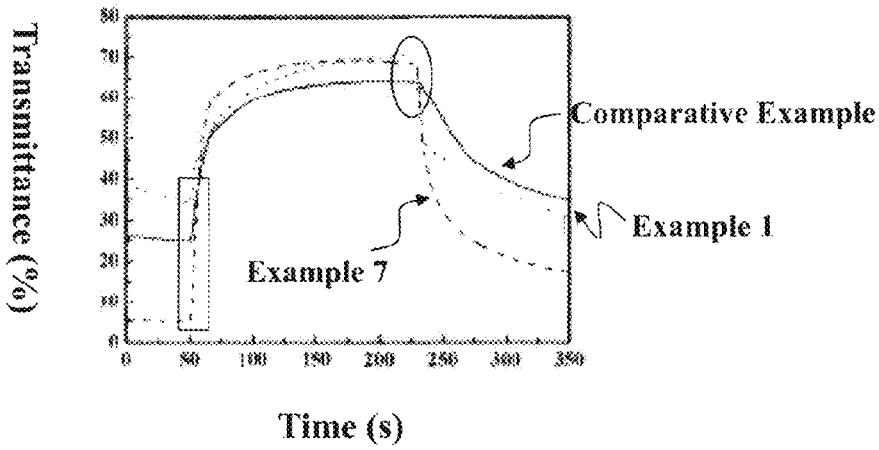
FIG. 8 is a graph to illustrate transmittance variation when the tungsten oxide thin films, in electrochromic device, of Examples 1, 7 and Comparative Example are provided with a forward bias for 200 seconds and then a reverse bias is provided.

With reference to FIG. 8, a graph shows transmittance variation of the tungsten oxide thin films, in the electrochromic device, of Examples 1, 7 and Comparative Example, wherein the tungsten oxide thin films are provided with a forward bias for 200 seconds and then a reverse bias is provided, in which the area covered by the "square frame" is defined as time to start applying the forward bias to the tungsten oxide thin film; the area covered by the "circular frame" is defined as time to start applying the reverse bias to the tungsten oxide thin film. The forward bias is applied to the tungsten oxide thin film at 50th second, maintained for 200 seconds, and then the reverse bias is applied to the tungsten oxide thin film at 250th second. Apparently, the tungsten oxide thin film of Example 7 has the highest transmittance variation to light of 632 nm.

Figure 9:
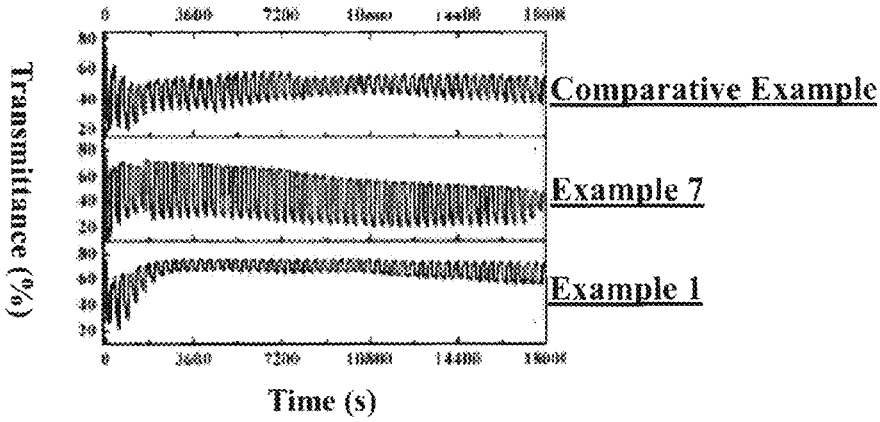
FIG. 9 is a graph to illustrate transmittance variation of the tungsten oxide thin films, in electrochromic device, of Examples 1, 7 and Comparative Example after being repeatedly provided with a forward bias and a reverse bias for fifty times.

With reference to FIG. 9, a graph shows transmittance variation of the tungsten oxide thin films in the electrochromic device after being repeatedly provided with a forward bias and a reverse bias for fifty times. Here, a colored/bleach cycle is defined as applying a forward bias and a reverse bias once respectively. Thus, the tungsten oxide thin film of Example 7 still has 40% transmittance variation after 30 colored/bleached cycles, and is more endurable than the tungsten oxide thin films of Example 1 and of Comparative Example.

Figure 10:
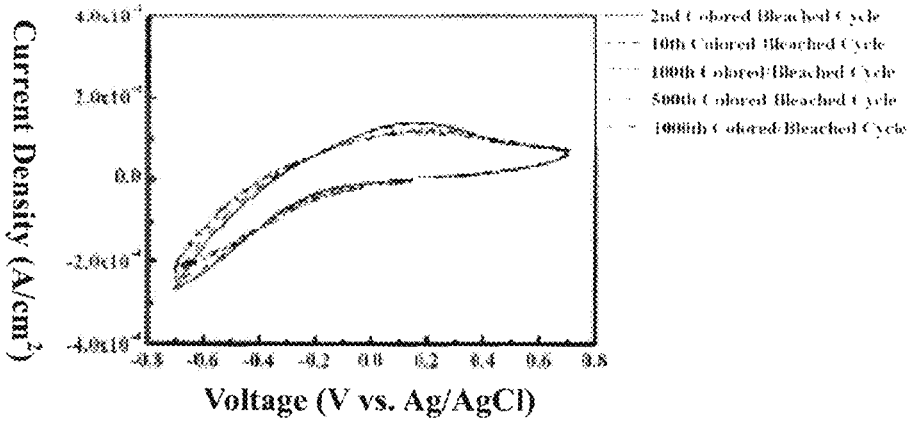
FIG. 10 is a graph to illustrate current density curves of the tungsten oxide thin film, in tri-electrode system, of Example 1 after being repeatedly provided with a forward bias and a reverse bias for multiple times.
Figure 11:
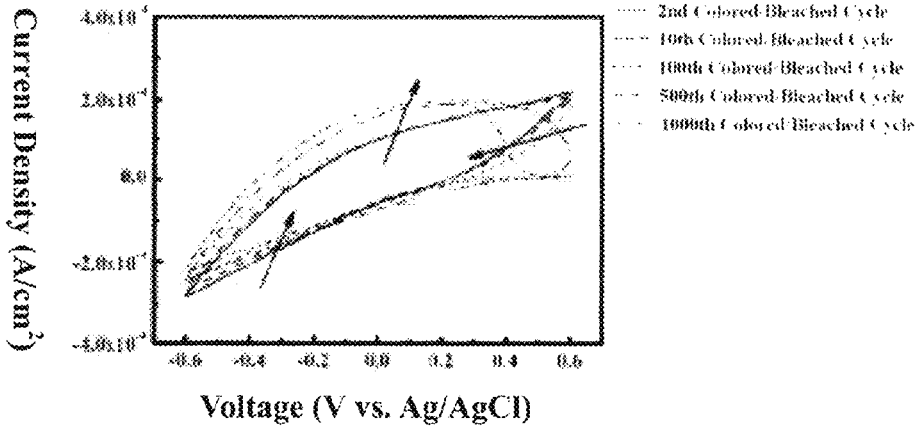
FIG. 11 is a graph to illustrate current density curves of the tungsten oxide thin film, in tri-electrode system, of Example 7 after being repeatedly provided with a forward bias and a reverse bias for multiple times.
Figure 12:
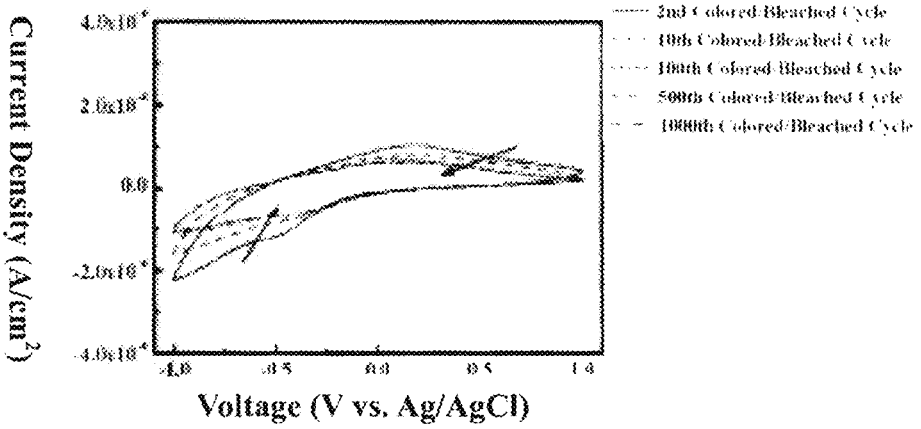
FIG. 12 is a graph to illustrate current density curves of the tungsten oxide thin film, in tri-electrode system, of Comparative Example after being repeatedly provided with a forward bias and a reverse bias for multiple times.

With reference to FIGS. 10 to 12, a colored/bleached cycle is defined as a cycle to apply a forward bias and a reverse bias to the tungsten oxide thin film in the tri-electrode system.

With reference to FIG. 10, the tungsten oxide thin film of Example 1 has a consistant current density curve after multiple colored/bleached cycles.

With further reference to FIG. 11, a current density curve of the tungsten oxide thin film of Example 7 is slightly changed after multiple colored/bleached cycles, and however, the area enclosed by the curve is substantially not changed, which indicates that the tungsten oxide thin film of Example 7 is reliable.

With further reference to FIG. 12, after multiple colored/bleached cycles, it is noted that the area covered by the current density curve of the tungsten oxide thin film of Comparative Example has a tendency to decrease, which demonstrates that the tungsten oxide thin film of Comparative Example is not reliable.

What is claimed is:

1. A method for manufacturing an oxide thin film, comprising:

simultaneously blending a first precursor material, a fuel material and a solvent to provide a coating material, wherein the first precursor material is a tungsten powder, the fuel material is selected from the group consisting of urea, glycine, citric acid, and combination thereof, the solvent is hydrogen peroxide, and the first precursor material, the fuel material and the solvent are in a weight ratio relationship of 1:0.3-0.8:1.2-1.7;

coating the coating material on a substrate; and annealing the coated coating material on the substrate to convert the coated coating material into a tungsten oxide thin film.

2. The method as claimed as claim 1, wherein the coating material further comprises a second precursor material for doping the tungsten oxide thin film, and the second precursor material is a nickel-containing material, a titanium-containing material, a zinc-containing material, a copper-containing material, or a silver-containing material.

3. The method as claimed as claim 1, wherein the coated coating material on the substrate is annealed at 300 to 550° C.

4. The method as claimed as claim 3, wherein the coated coating material on the substrate is annealed at 350 to 450° C.

5. The method as claimed as claim 1, wherein the coated coating material on the substrate is annealed at 300 to 550° C. for 10 minutes to 6 hours.

6. The method as claimed as claim 5, wherein the coated coating material on the substrate is annealed at 300 to 550° C. for 10 minutes to 1 hour.

7. The method as claimed as claim 1, wherein the substrate is a glass or a transparent conducting oxide.

8. The method as claimed as claim 7, wherein the transparent conducting oxide is an indium tin oxide (ITO) or a fluorine tin oxide (FTO).

9. The method as claimed as claim 1, wherein the fuel material is urea.

10. The method as claimed as claim 1, wherein the fuel material is glycine.

11. The method as claimed as claim 1, wherein the fuel material is citric acid.

* * * * *